US007119754B2

(12) United States Patent
Lenormand

(10) Patent No.: US 7,119,754 B2
(45) Date of Patent: Oct. 10, 2006

(54) RECEIVING ANTENNA FOR MULTIBEAM COVERAGE

(75) Inventor: Regis Lenormand, Blagnac (FR)

(73) Assignee: Alcatel, Paris (FR)

( * ) Notice: Subject to any disclaimer, the term of this patent is extended or adjusted under 35 U.S.C. 154(b) by 0 days.

(21) Appl. No.: 10/503,097

(22) PCT Filed: Jan. 17, 2003

(86) PCT No.: PCT/FR03/00140

§ 371 (c)(1),
(2), (4) Date: Jul. 30, 2004

(87) PCT Pub. No.: WO03/065507

PCT Pub. Date: Aug. 7, 2003

(65) Prior Publication Data

US 2005/0088356 A1 Apr. 28, 2005

(30) Foreign Application Priority Data

Jan. 31, 2002 (FR) ..... 02 01140

(51) Int. Cl.
*H01Q 13/00* (2006.01)

(52) U.S. Cl. ..... 343/781 R

(58) Field of Classification Search ..... 343/834, 343/781 R

See application file for complete search history.

(56) References Cited

U.S. PATENT DOCUMENTS 3,775,773 A * 11/1973 Nemit ..... 343/781 R
4,236,161 A * 11/1980 Ohm ..... 343/781 CA
5,202,700 A 4/1993 Miller
6,078,287 A * 6/2000 Thompson et al. ..... 342/368
6,172,649 B1 * 1/2001 Lenormand et al. ..... 343/781 P
6,225,964 B1 * 5/2001 Fermelia et al. ..... 343/909
6,320,553 B1 * 11/2001 Ergene ..... 343/781 P
6,366,256 B1 * 4/2002 Ramanujam et al. . 343/781 CA
2004/0125037 A1 * 7/2004 Parsons et al. ..... 343/781 P

FOREIGN PATENT DOCUMENTS

DE 3605195 A1 8/1987
EP 1 020 950 A2 7/2000
EP 1 124 283 A2 8/2001

* cited by examiner

*Primary Examiner*—Binh V Ho
(74) *Attorney, Agent, or Firm*—Sughrue Mion, PLLC

(57) ABSTRACT

The invention relates to a receiving antenna for satellite telecommunications. More specifically, the invention relates to an active antenna comprising a network of elementary sources which is positioned at the focal point of a focusing reflector. According to the invention, said network of sources is disposed on a more or less spherical, concave surface S. The aforementioned arrangement can be used to: (i) improve the efficiency of the optics and (ii) enable the use of polarisation duplexers behind surface S in order to increase the spectral efficiency of the antenna.

14 Claims, 7 Drawing Sheets

RECEIVING ANTENNA FOR MULTIBEAM COVERAGE

The field of the invention is that of multibeam antennas for satellite telecommunication applications. This kind of antenna serves a plurality of spots on the ground with spot beams of radiation.

The invention relates more particularly to an antenna having one or more focusing reflectors with an array of individual sources placed in the focal area. This kind of antenna geometry is known to the person skilled in the art as a focal array fed reflector (FAFR). In this kind of antenna, each spot is produced by coherently grouping signals from a subset of individual sources with appropriate amplitudes and phases to obtain the required antenna diagram, in particular the required size and sighting direction of the main radiation lobe.

The patent application D1=FR 97 08 011=U.S. Pat. No. 6,172,649 in the name of the Applicant discloses a Gregorian geometry multibeam antenna as shown in FIG. 1.

The antenna comprises a plane panel 30 of radiating elements associated with a beam forming network (not shown) for controlling the phase of the signals applied to the radiating elements. A beam 32 emitted by the panel 30 is directed towards a first concave reflector 34 having the shape of a circular rim paraboloid. The reflector is a portion of an imaginary surface 36 whose axis 38, on which the focus 40 is located, is far away from the reflector 34.

The axis 38 is perpendicular to the plane of the panel 30.

The beam 42 reflected by the reflector 34 is directed towards a concave second reflector 44 disposed on the opposite side of the axis 38 to the reflector 34 and the panel 30. The reflector 44 is also a portion of an imaginary surface 46 which is a parabola in the plane of FIG. 1 and has the same focus 40 and the same axis 38 as the parabola 36. The surface 46 is also a paraboloid.

The concave side of the reflector 44 faces towards the concave side of the reflector 34.

The focal length of the reflector 44 is one quarter the focal length of the reflector 34, for example.

The axis 38 does not intersect the reflectors 34 and 44. The edge $\mathbf{44}_1$ of the reflector 44 nearest the axis 38 is at a distance from the axis significantly smaller than the distance between the corresponding edge $\mathbf{34}_1$ of the reflector 34 and the axis 38.

In the example shown in FIG. 1, the array 30 has the general exterior shape of a circle with a diameter of approximately 30 cm (12λ) with 37 radiating elements separated from each other by a distance of 42 mm (1.7λ), where λ is the wavelength of the radiation.

Each of the reflectors has a circular rim. In this example the diameter of the circle delimiting the reflector 34 is of the order of 28λ and the diameter of the circle delimiting the reflector 44 is of the order of 30λ. The distance between the edge $\mathbf{34}_1$ and the axis 38 is 24λ and the distance between the edge $\mathbf{44}_1$ of the reflector 44 and the axis 38 is 4λ.

When the array 30 emits a beam of waves $\mathbf{32}_1$ parallel to the axis 38, i.e. perpendicular to its plane, the beam is reflected by the reflector 34 so that it is focused at the focus 40 and the reflector 44 reflects the beam $\mathbf{32}_2$ parallel to the axis 38, to form the beam $\mathbf{32}_3$.

When the array 30 emits a beam $\mathbf{32}_5$ inclined at a relatively small angle Θ to the axis 38, the beam $\mathbf{32}_6$ reflected by the reflector 34 converges at a point 50 close to the focus 40 and the beam $\mathbf{32}_7$ reflected by the reflector 44 is inclined at an angle that is approximately n times the angle Θ, n being the ratio of the focal length f of the reflector 34 to the focal length f' of the reflector 44. In this example this ratio of the focal lengths is equal to 4 and the beam $\mathbf{32}_7$ is therefore inclined to the axis 38 at an angle 4Θ.

However, this amplification of the focal length ratio is not obtained for beams $\mathbf{32}_{10}$ emitted by the array 30 that are inclined at a large angle to the axis 38.

Thus FIG. 1 shows that the beam $\mathbf{32}_{10}$ reflected by the reflector 34 forms a beam $\mathbf{32}_{11}$ which converges at a point 52 far from the focus 40. The beam $\mathbf{32}_{11}$ reflected by the reflector 44 forms a beam $\mathbf{32}_{12}$.

The above geometry has many advantages for installation on board a satellite, including its compactness, its relatively small dimensions, leading to a lower weight, and the possibility of mounting the electronics associated with each individual source directly on the body of the satellite.

The patent application D2=FR 95 00 515=U.S. Pat. No. 5,734,349=EP 0 723 308 in the name of the Applicant discloses an offset geometry multibeam FAFR antenna, as shown in FIG. 2. The term "offset" means that the array 110 of individual sources is offset relative to the focus F of the parabolic reflector 100. Most importantly, the array 110 of sources is positioned away from the main direction of the radiation reflected by the reflector so as not to shade the latter. It is possible to synthesize the response of a virtual source 120 placed exactly at the focus F of the reflector by modifying the phases and amplitudes of the signals.

FIG. 3 shows one example of a plane focal array 110 of individual sources (A, B, C, D) from the same document D2, with a hexagonal arrangement of 61 individual sources 31 distributed over a plane array 110 intended to be positioned in the focal plane of a focusing reflector 100. The sources fed from each group A, B, C, D are indicated by the corresponding letter. Note that no source of a given group is adjacent another source of the same group.

According to the teaching of the document D2, the number Ni of sources contributing to the beam i varies and is determined as a function of the required characteristics of the beam i. As a result, a plurality of sources contribute to forming each spot beam and each source may contribute to a plurality of spot beams. This is also the case in the document D1.

However, for the antennas described in D1 and D2, there is a practical limit on the number of sources that may be positioned in the vicinity of the focus of a focusing reflector without being too far away from it, which would cause distortion, aberrations and other losses of beam formation efficiency.

This constraint has led us to consider an FAFR antenna design in which the sources are contiguous, which yields a spacing of the order of 1.2λ for a hexagonal mesh of the kind shown in FIG. 3.

The document D3=U.S. Pat. No. 5,202,700 relates to an FAFR radar antenna for air traffic control. Using an offset geometry, this antenna produces multiple spot beams in elevation only, with sources deployed over the surface of a convex cylinder for phase correction and side lobe reduction. This antenna can operate with circular polarization.

The document D4=U.S. Pat. No. 4,535,338 describes a multispot antenna having a Cassegrain geometry with a convex first subreflector 12 in front of a main concave parabolic second reflector 10. This arrangement is shown diagrammatically in FIG. 4.

This antenna, of more conventional design, comprises a horn source ($\mathbf{14}_1$, $\mathbf{14}_2$, $\mathbf{14}_3$) for each beam ($\mathbf{15}_1$, $\mathbf{15}_2$, $\mathbf{15}_3$), each beam comprises a single horn source, and the sources are spaced in the focal plane and oriented so that a central ray from each horn, after reflection at the first reflector 12, impinges on the main reflector 10 at a single point C.

However, this solution is not suitable for the target applications of the present invention. The antenna of the invention is designed to provide the reception function for a coverage made up of a multiplicity of contiguous small spots. An antenna solution associating a source with each spot is not suitable because it would lead to overlapping of the sources.

Furthermore, the antenna of the invention is designed to operate at high frequencies, from the Ku band (approximately 11 to 15 GHz) to the Ka band (approximately 20 to 40 GHz and beyond), which means that the dimensions of the individual resonant sources would be very small, of the order of one centimeter. As in the documents D1 to D3, each spot beam of the antenna of the invention is formed by exciting a multiplicity of individual sources, generally no fewer than seven sources.

The small dimensions of the contiguous individual sources and their large number, a significant number of the sources being involved in the formation of each beam, make the rear connectors of these sources a problem. For a receive antenna, a low-noise amplifier must be placed as close as possible to the sensor consisting of the individual source to minimize propagation losses in the waveguides providing the interface. Each individual source is associated with a variable phase shifter and a variable attenuator or amplifier, together with their control electronics. The phase shift and attenuation or amplification are applied on the upstream side of the beam forming networks to create each spot of the coverage.

For the same reason that many contiguous small spots are used to obtain the best possible reuse of frequencies over the coverage area, two orthogonal polarizations are used. This implies, in addition to the devices listed above, inserting polarization multiplexers, also known as "orthomode multiplexers", between the individual sources and the low-noise amplifiers. Designers of antennas satisfying all of the above constraints are confronted with serious problems of overall size to the rear of the plane of the individual sources.

The antenna of the invention seeks to solve these various problems simultaneously. To this end, the invention proposes a receiving antenna for multispot coverage, comprising at least one focusing reflector (34, 44, 100) and one focal array (30, 110) of individual sources (31) disposed in the focal area of said focusing reflector (34, 44, 100), characterized in that said sources (31) are substantially contiguous and disposed on a concave and approximately spherical surface S.

According to one advantageous feature, a plurality of individual sources are used to form each beam which illuminates a respective spot of said coverage. According to another advantageous feature, one individual source contributes to the formation of a plurality of different beams. The number of individual sources used in the formation of a single beam is preferably greater than or equal to seven. The number of individual sources contributing to a beam is advantageously not the same for all the beams, being determined as a function of the required characteristics of each beam.

A preferred embodiment of the antenna comprises two concave reflectors (34, 44) in a "Gregorian" geometry. In a variant, the antenna comprises a single concave reflector (100) in an offset geometry.

A preferred embodiment of the antenna further comprises polarization duplexers (20) behind each individual source. Another embodiment of the antenna is designed to operate with only one polarization and there is no polarization duplexer.

According to a preferred feature the individual sources have a dimension not exceeding 1.2 times the wavelength.

Other advantages and features of the invention will emerge from the following detailed description and the appended drawings, which are provided by way of nonlimiting example, of embodiments of the invention and a few of its main characteristics, in which drawings:

FIG. 1, already referred to, represents diagrammatically an antenna with an array of active elements having a Gregorian geometry with two facing concave reflectors (34, 44);

FIG. 2, already referred to, shows diagrammatically a prior art offset antenna with a focusing concave reflector 100 and an array 110 of individual sources 31 at its focus F;

FIG. 3, already referred to, shows one example of the arrangement of the individual sources 31 in four groups A, B, C, D in a hexagonal mesh;

FIG. 4, already referred to, shows diagrammatically a prior art Cassegrain antenna with a concave first reflector 12 and a concave focusing main reflector 10 illuminated by individual horns $\mathbf{14}_1$, $\mathbf{14}_2$, $\mathbf{14}_3$ in a conventional geometry with one source per beam, respectively $\mathbf{15}_1$, $\mathbf{15}_2$, $\mathbf{15}_3$;

In all the figures, the same reference numbers refer to the same items; to clarify the drawings, they are not all to scale.

Figure 1:
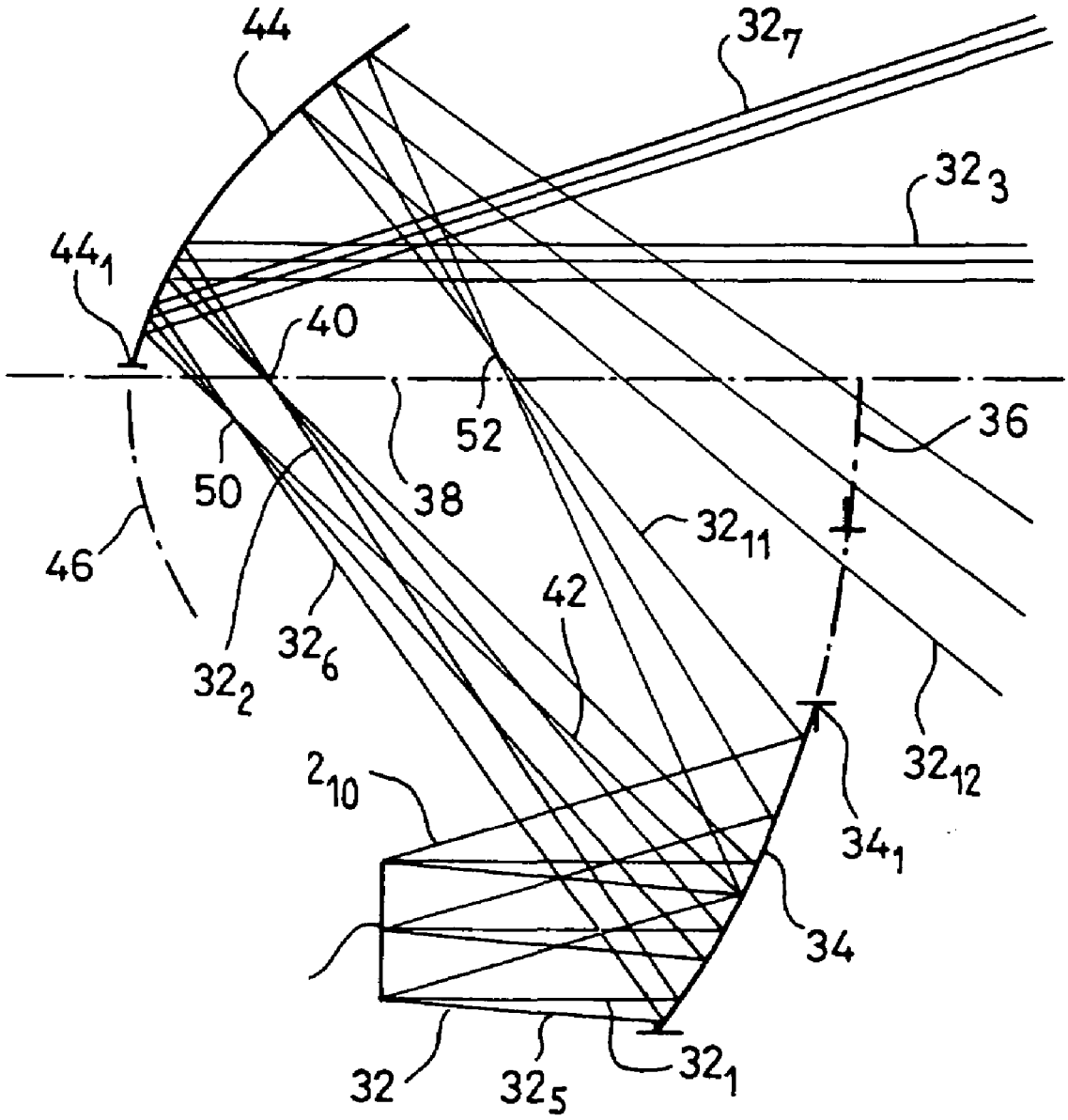
Figure 2:
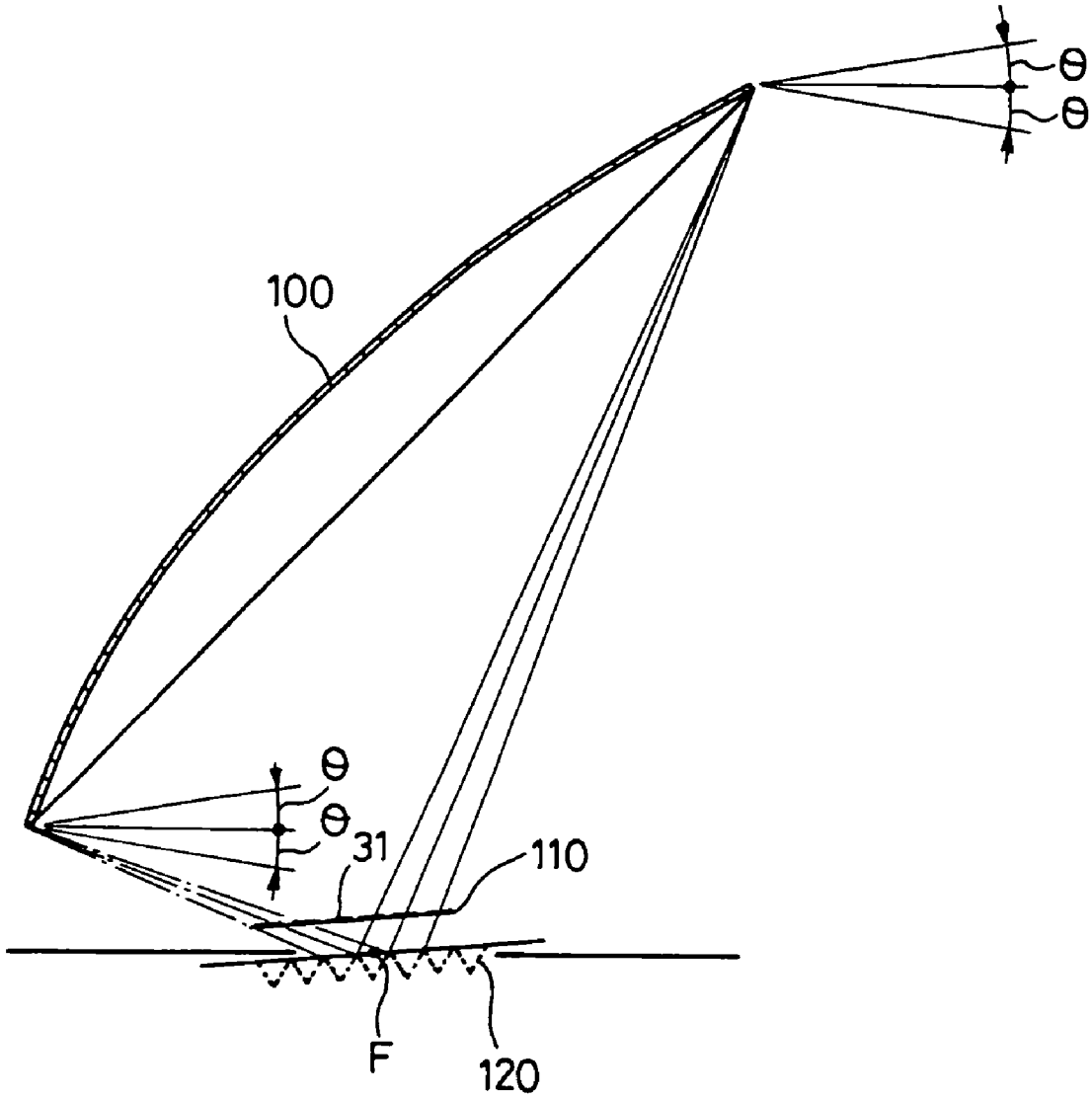
Figure 3:
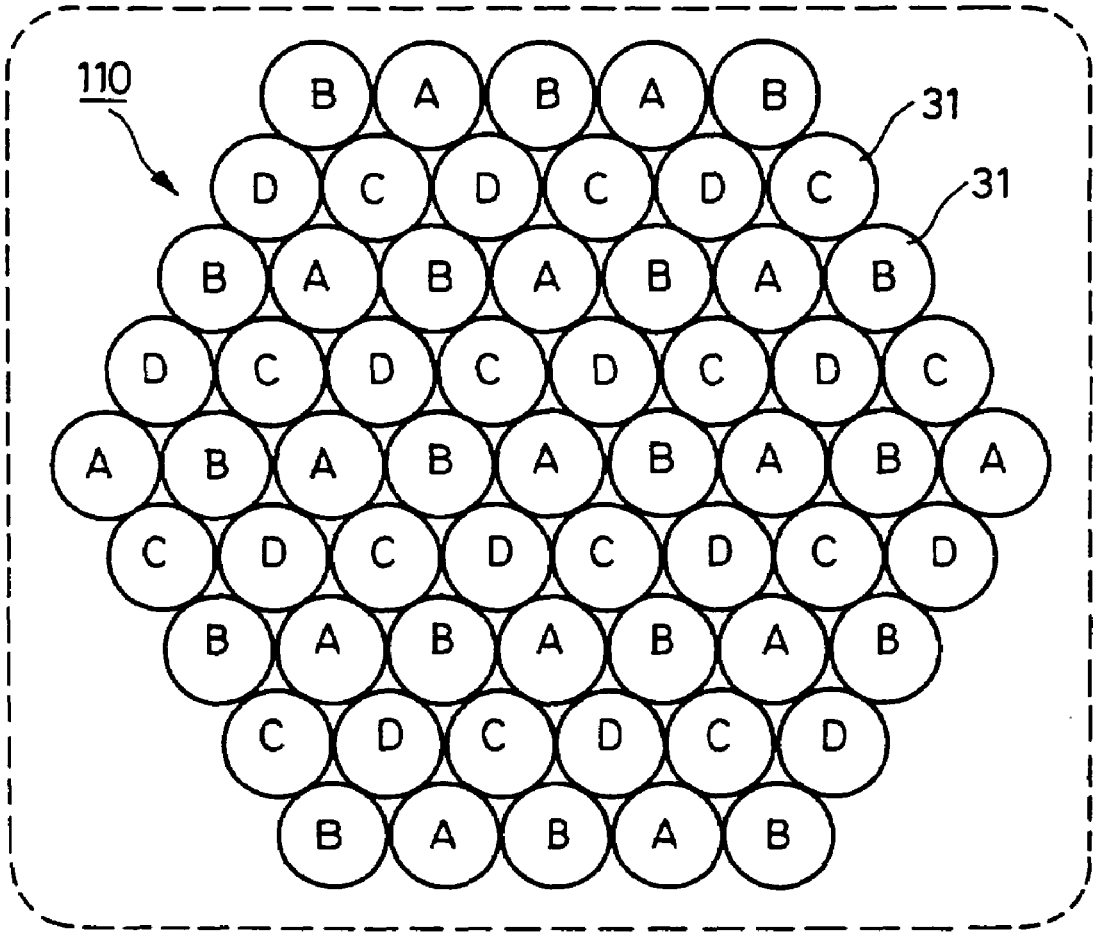

The production of an antenna according to the invention is based partly on the prior art technologies shown in FIGS. 1 to 3, which represent prior art embodiments.

Thus the antenna of the invention comprises an array (30, 11) of $N_e$ individual sources 31 and optical means that form a reflector 10, 34, 44 and focus energy, the array being situated in the focal area of said focusing means, as shown in FIGS. 1 and 2.

The individual sources are contiguous, either in a hexagonal mesh as shown in FIG. 3 or in a rectangular mesh. It is advantageous if a plurality of sources contribute to only one beam and each source may contribute to more than one beam. The sources may be divided into groups A, B, C, D that are excited and amplified separately; this improves the isolation between adjacent sources and simplifies the architecture of the amplification stage.

Figure 4:
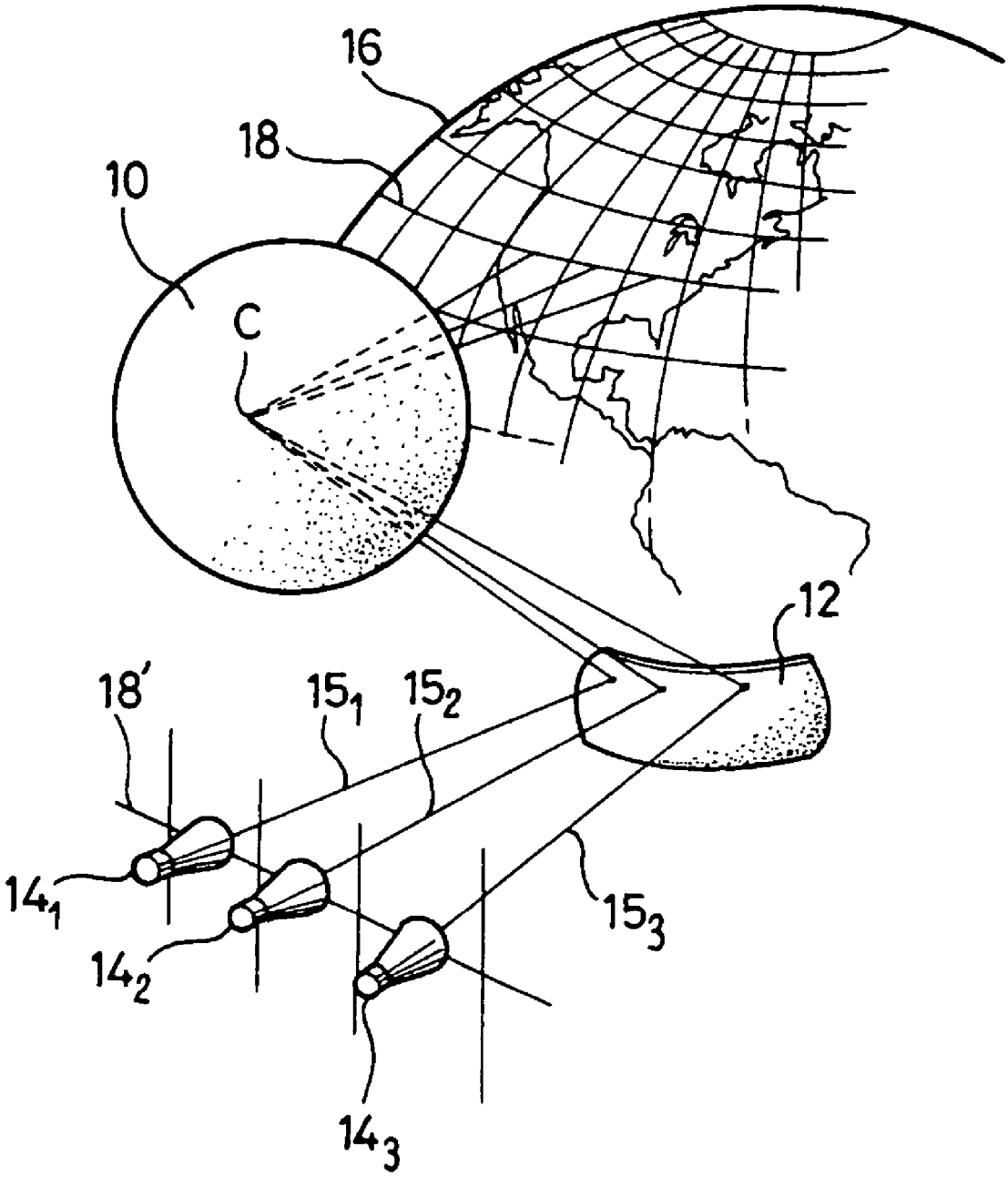

Of all the figures, only FIG. 4 shows a teaching contrary to that of the invention. A single source is used for each corresponding spot beam. There is no focal array and the sources are separate rather than contiguous. Moreover, they are placed in front of a divergent convex reflector 12, which contributes to increasing the distance between the sources, which is contrary to the invention.

Figure 5:
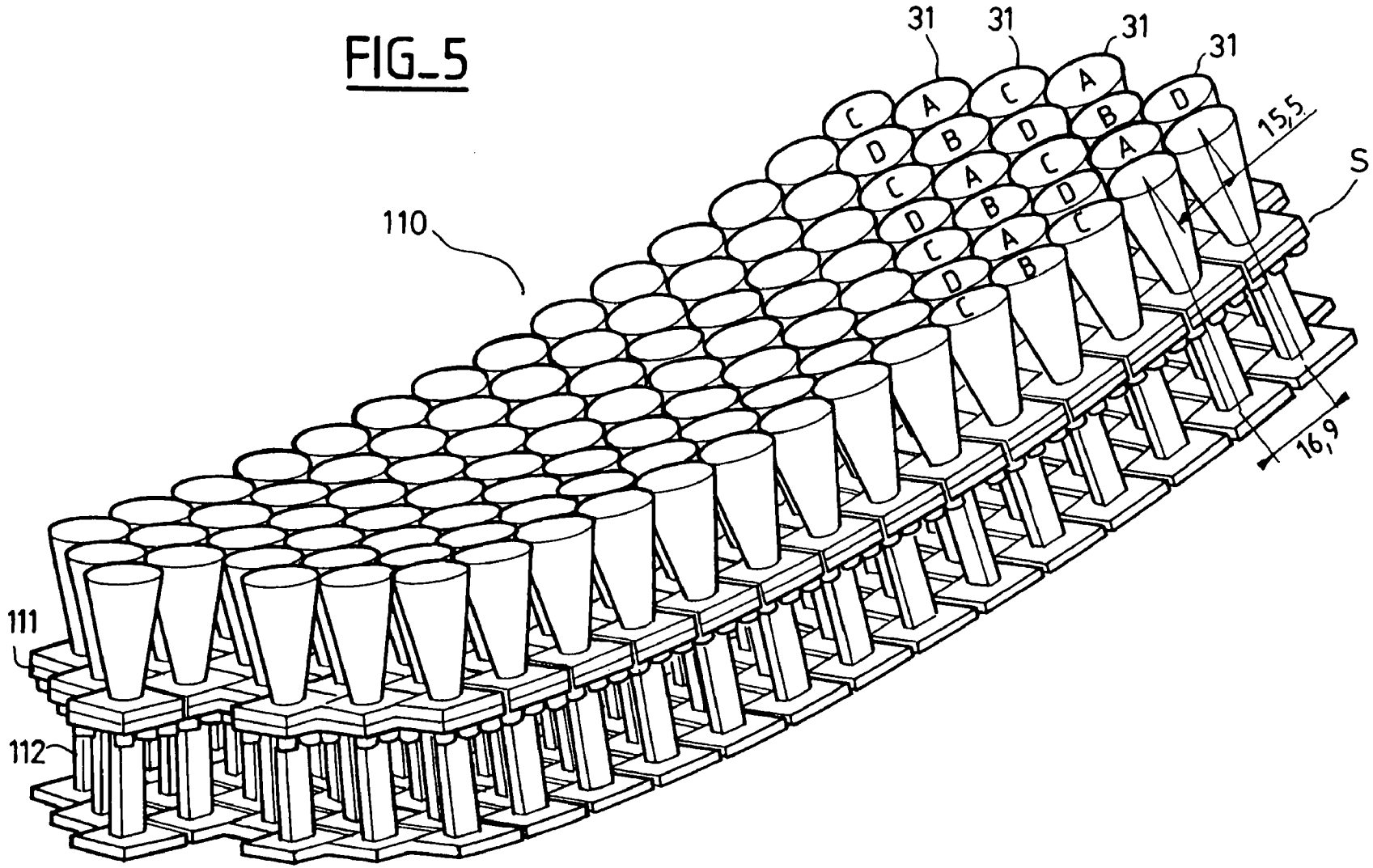
FIG. 5 shows diagrammatically a first example of a focal array of substantially contiguous individual sources 31 disposed on an approximately spherical concave surface S and adapted to be integrated into the antenna of the invention.

FIG. 5 shows diagrammatically a first example of a focal array of substantially contiguous individual sources 31 disposed on an approximately spherical concave surface S and adapted to be integrated into an antenna of the invention. The shape of the surface S improves the efficiency of the antenna, because of the geometrical optics, and means that the sources may be very tightly packed together on the front surface of the array, but with more space between the output waveguides 112 on the rear face of the array.

In an advantageous embodiment, the individual sources may be divided into groups, for example groups A, B, C, D as in FIG. 3. They may be disposed in a hexagonal mesh as shown here or any other mesh chosen by the designer. In this example, the sources are horns connected to the output waveguides 112 by flanges 111.

Figure 6:
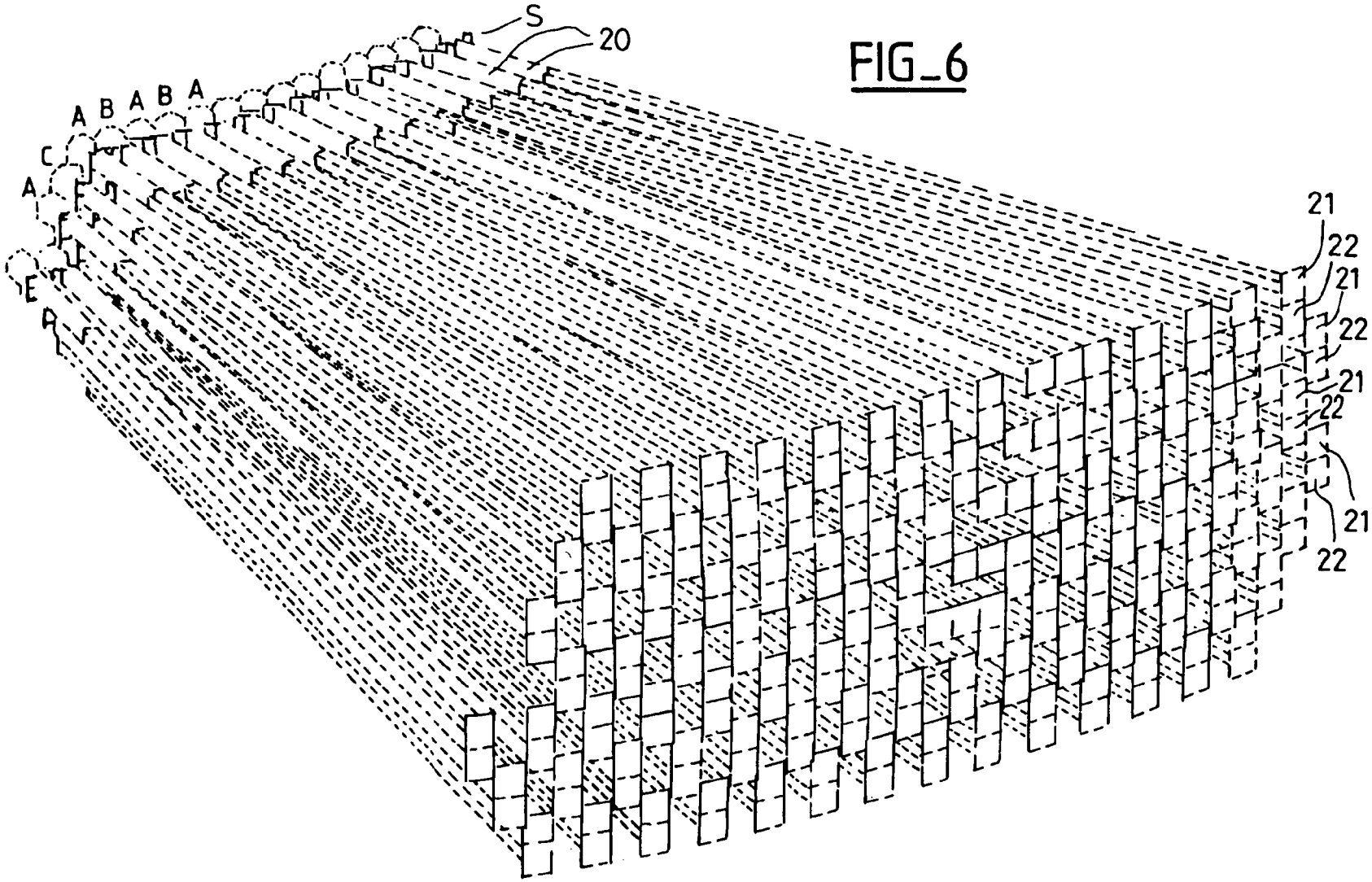
FIG. 6 shows diagrammatically a second example of a focal array of substantially contiguous individual sources 31 disposed on an approximately spherical concave surface S and adapted to be integrated into the antenna of the invention.

FIG. 6 shows diagrammatically a second example of a focal array of substantially contiguous individual sources 31 disposed on an approximately spherical concave surface S and adapted to be integrated into the antenna of the invention. In this example, the increased space between guides on the rear face of the array may be exploited to add polarization duplexers 20, also known as "orthomode duplexers". These duplexers 20 separate the signals into two orthogonal polarizations, for example horizontal and vertical polarizations (H, V), that are thereafter conveyed in respective waveguides, for example an H waveguide 21 and a V waveguide 22.

Without the curvature of the surface, there would be no room to install the polarization duplexers 20 or to double the number of waveguides on the rear face in the manner shown in FIG. 6. However, the reuse of frequency enabled by the polarization duplexers doubles the capacity of the antenna, which is a decisive advantage of this embodiment.

Figure 7:
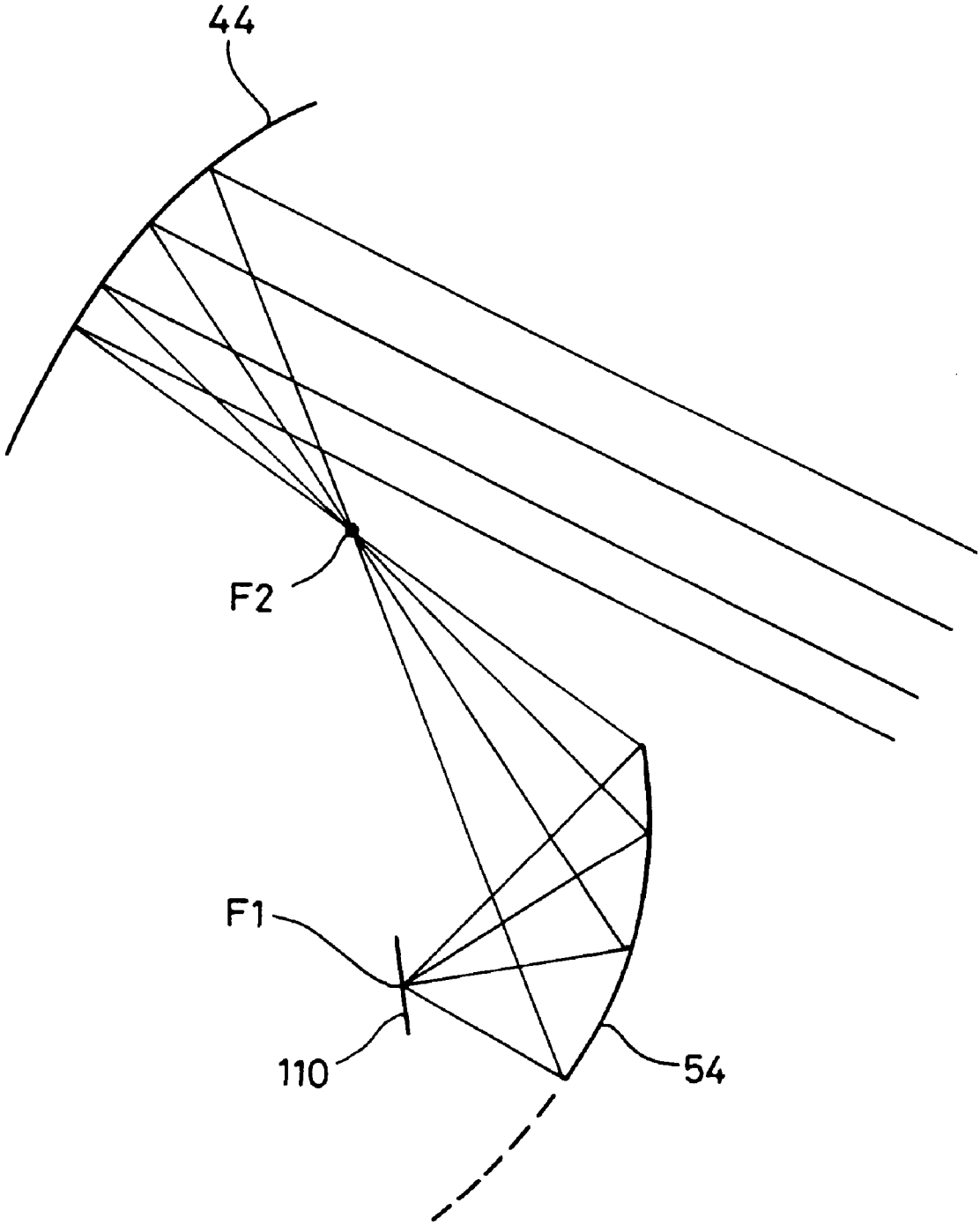
FIG. 7 shows diagrammatically one example of a focal array antenna of the invention with a Gregorian geometry comprising a concave ellipsoidal first reflector and a concave paraboloidal second reflector cofocal with the first reflector.

FIG. 7 shows diagrammatically an example of a focal array network of the invention with a Gregorian geometry. This antenna comprises a concave ellipsoidal first reflector 54 having two focal points F1 and F2. A focal array 110 of active elements is placed in the vicinity of the first focus F1 . One property of the geometry of an ellipsoid is that all the rays emitted from one of the focal points (for example the focal point F2) and reflected by the ellipsoidal reflector 54 will be focused at the other focal point (the focal point F1).

A concave paraboloid second reflector 44 is positioned with its focus coincident with the second focus F2 of said first reflector, the two concave reflectors facing each other. Incident parallel waves reflected by the paraboloidal reflector 44 are therefore focused at the focus F2 and are then refocused onto the focal array 110, at the focus F1, by the ellipsoidal reflector 54.

This geometry represents a preferred embodiment of the invention, but other antenna geometries with other types and dispositions of the reflectors may be contemplated, yielding a large number of variants.

The few examples described hereinabove have been described to illustrate the general principles of the invention and a few of its main characteristics in a nonlimiting manner. The person skilled in the art will know how to apply its principles to multiple embodiments that do not depart from the scope of the invention.

In particular, the main feature of the invention may be combined with the features of prior art embodiments, for example those cited in the documents D1 and D2, as explained hereinabove.

The invention claimed is:

1. Receiving antenna for multispot coverage, comprising at least one focusing reflector (34, 44, 100) and one focal array (30, 110) of individual sources (31) disposed in the focal area of said focusing reflector (34, 44, 100), characterized in that said sources (31) are substantially contiguous and disposed on a concave and approximately spherical surface (S); and wherein the at least one focusing reflector is concave and faces the one focal array.

2. Antenna according to claim 1, characterized in that a plurality of individual sources (31) are used to form each beam which illuminates a respective spot of said coverage.

3. Antenna according to claim 1, characterized in that one individual source contributes to the formation of a plurality of different beams.

4. Antenna according to claim 1, characterized in that the number of individual sources used in the formation of a single beam is greater than or equal to seven.

5. Antenna according to claim 1, characterized in that the number of individual sources contributing to a beam is not the same for all the beams, being determined as a function of the required characteristics of each beam.

6. Antenna according to claim 1, characterized in that said antenna comprises two concave reflectors (34, 44) in a "Gregorian" geometry.

7. Antenna according to claim 1, characterized in that said antenna comprises a single concave reflector (100) in an offset geometry.

8. Antenna according to claim 1, characterized in that said antenna further comprises polarization duplexers (20) behind each individual source.

9. Antenna according to claim 1, characterized in that said antenna is designed to operate with only one polarization and there is no polarization duplexer.

10. Antenna according to claim 1, characterized in that said individual sources have a dimension not exceeding 1.2 times the wavelength.

11. A receiving antenna, comprising a concave focusing reflector, and a focal array comprising individual sources disposed in the focal area of the focusing reflector, wherein the sources are substantially contiguous and disposed on a concave surface; and the focusing reflector generally faces the focal array, and wherein the sources are disposed on a spherical or approximately spherical surface.

12. The receiving antenna according to claim 11, wherein the sources are beam emitting or receiving horns.

13. The receiving antenna according to claim 11, further comprising polarization duplexers disposed on a rear surface of the focal array, the polarization duplexers structured to transmit signals to waveguides behind the focal array.

14. The receiving antenna according to claim 11, wherein the sources are disposed on a concave and approximately spherical surface.

* * * * *